US007313994B1

(12) United States Patent
Lacombe et al.

(10) Patent No.: US 7,313,994 B1
(45) Date of Patent: Jan. 1, 2008

(54) APPARATUS AND METHOD FOR BLAST SUPPRESSION

(75) Inventors: Chris Lacombe, Rayne, LA (US); Keith Scott, Duson, LA (US); Jeffrey Lynn Hildreth, New Iberia, LA (US)

(73) Assignee: Burner Fire Control, Inc., Lafayette, LA (US)

( * ) Notice: Subject to any disclaimer, the term of this patent is extended or adjusted under 35 U.S.C. 154(b) by 0 days.

(21) Appl. No.: 11/283,989

(22) Filed: Nov. 21, 2005

Related U.S. Application Data

(63) Continuation of application No. 10/734,453, filed on Dec. 12, 2003, now abandoned.

(51) Int. Cl.
*F42B 33/00* (2006.01)
*F42D 5/045* (2006.01)

(52) U.S. Cl. ..... 86/50; 102/303

(58) Field of Classification Search ..... 86/50; 102/303; 109/3, 8.05
See application file for complete search history.

(56) References Cited

U.S. PATENT DOCUMENTS 232,640 A * 9/1880 Hallock ..... 102/301
4,392,412 A * 7/1983 Schmidt et al. ..... 89/14.4
4,541,947 A * 9/1985 Clark et al. ..... 516/10
4,543,872 A 10/1985 Graham et al.
4,589,341 A 5/1986 Clark et al.
4,836,079 A 6/1989 Barrett
4,836,939 A * 6/1989 Hendrickson ..... 252/3
4,964,329 A 10/1990 Moxon et al.
5,225,622 A 7/1993 Gettle et al.
5,394,786 A 3/1995 Gettle et al.
5,719,350 A * 2/1998 Parkes et al. ..... 102/303
5,864,767 A * 1/1999 Drumgoole et al. ..... 588/313
6,196,107 B1 3/2001 Hoffman et al.
6,341,708 B1 1/2002 Palley et al.
6,405,626 B1 6/2002 Bureaux et al.
6,439,120 B1 8/2002 Bureaux et al.
6,553,887 B1 4/2003 Bureaux et al.
6,901,839 B2 * 6/2005 Edberg et al. ..... 89/36.17

OTHER PUBLICATIONS

Smith, Hildreth & White, "The Use of Alcohol Resistant-Aqueous Film Forming Foam (AR-AFFF) Delivered With a Compressed Air Foam System (CAFS) as a Blast Mitigant", Jan. 1999 (copy enclosed).
Smith, Hildreth & Lacombe, "The Use of Specialized Compressed Air Foam as a Blast Mitigant in Dynamite and Pipe Bomb Explosions," Apr. 1999 (copy enclosed).

* cited by examiner

*Primary Examiner*—Bret Hayes
(74) *Attorney, Agent, or Firm*—Ted M. Anthony

(57) ABSTRACT

An improved method of blast suppression involves forming a foam barrier in proximity to a bomb or other suspicious device. The foam is maintained in position by a containment structure which is inflated and kept in an inflated state by the foam used to form such barrier. Various containment structures and methods are disclosed for suppression of compression waves and combustion effects caused by an explosive event.

2 Claims, 6 Drawing Sheets

APPARATUS AND METHOD FOR BLAST SUPPRESSION

CROSS REFERENCES TO RELATED APPLICATIONS

This is a continuation of application Ser. No. 10/734,453, filed Dec. 12, 2003, now abandoned.

STATEMENTS AS TO RIGHTS TO INVENTIONS MADE UNDER FEDERALLY SPONSORED RESEARCH AND DEVELOPMENT

None

BACKGROUND OF THE INVENTION

1. Field of the Invention

The present invention relates to a method and apparatus for the suppression of shock waves, combustion, fragmentation and/or contamination caused by bombs, explosive devices and the like. More particularly, the present invention relates to a method and apparatus which permits on-site disarming, detonation and/or disruption of bombs and/or other explosive devices while reducing and/or eliminating damage to, and contamination of, surrounding areas. More particularly still, the present invention relates to an inexpensive, simple to use and environmentally acceptable blast suppression system which can be quickly and easily mobilized with minimal exposure to a bomb or other explosive device, and which can also be deployed by personnel in protective gear, robots or other remotely-operated devices.

2. Description of the Prior Art

Bombs and other improvised explosive devices have presented a challenge for law enforcement officials for some time. For ease of reference, the term improvised explosive device ("IED") will be used throughout this discussion. However, it is to be understood that the term IED refers to any bomb or other explosive device, and such term is not intended to be limiting in any manner.

Generally, when an IED, or other suspicious device is discovered, care is taken to avoid moving or otherwise disturbing the IED to prevent premature or inadvertent detonation of the device. Accordingly, a common procedure has been for trained bomb disposal personnel to attempt to disarm such IED's in the location where they are found. However, in many instances, IED's can be quite sophisticated, and trained personnel may not be readily available to deal with the problem. Thus, there is a need for an affordable, efficient and effective means to protect personnel and property from the blast effects of an IED until law enforcement officials can arrive to disarm or otherwise disable the device.

In many instances, the nature of an IED is such that it is not readily capable of being completely disarmed at the site where it is first discovered. In such cases, an attempt is often made to initiate a controlled detonation of the device where it is found by using a smaller explosive charge to detonate the main charge of the IED. In other cases, a smaller explosive charge can be used to deactivate the main explosive device by destroying wires or disabling the primary detonation mechanism of the IED. However, these procedures can also result in unintended detonation of the main device, thereby causing a powerful blast. Thus, there is also a need for an inexpensive, efficient and effective means to protect personnel and property while attempts are being made to disarm or disable an IED.

Generally, damage caused by an IED results from two primary sources: (1) a compression wave or blast; and (2) a fire ball or similar combustion effect. A compression wave is usually a high amplitude, short duration disturbance which moves radially outward from the source of an explosion in all directions. The strength and duration of such wave typically depends on the power and amount of the explosives used in the IED. A fire ball, on the other hand, generally results from ignition of combustible materials in the immediate vicinity of an IED. Both the compression wave and the fire ball/combustion effect of an IED can cause significant damage to the environment surrounding an IED. Accordingly, there is a need for a means to suppress the negative effects of both compression waves and fire balls caused by detonation of an IED.

Additionally, great concern has been expressed regarding radiological bombs or so-called "dirty bombs." Such devices are essentially conventional explosives which are wrapped in, or otherwise combined with, radioactive materials. Detonation of the conventional explosives causes a blast which has the effect of dispersing such radioactive materials, thereby contaminating the environment around the IED with said radioactive material. Although the blast from the conventional explosives may or may not cause significant damage, contamination of a large or sensitive area with radioactive material can be especially problematic. As such, in addition to suppression of compression waves and/or fire balls caused by detonation of conventional explosives, there is also a need for means to reduce or eliminate the dispersal of radiological and/or other contaminants resulting from detonation of a dirty bomb or radiological device.

Foam has been used for some time to fight fires. More recently, foam has also been used to attempt to control damage caused by IED's. However, such attempts at using foams for this purpose have met with only limited success. Typically, foams used for these purposes are formed from water-soluble surfactants of the perfluorocarbon type which may be dispensed from a variety of different types of equipment. One such foam is known in the art as aqueous film forming foam ("AFFF"). Another type of foam which is well known in the art is so-called "high expansion" foam. Neither of these foams have heretofore proven to be especially effective at controlling blast effects from IED's, especially in formulations commonly used in fire fighting applications.

AFFF foams generally exhibit irregular bubble structures and relatively short drain or "break down" times. By contrast, high expansion foams are primarily designed to produce large quantities of finished foam solution with much greater expansion ratios (up to 1000:1). Such high expansion foams are often used to fill voids and smother conventional Class A fires, such as basement, shipboard and mine fires. These foams frequently produce larger, fragile bubbles which entrap more air, but are extremely susceptible to weather conditions such as wind and rain. The drain or "break down" times of high expansion foams are typically less than fifteen minutes.

Although foams have generally proven to be useful in fighting fires, they have not been entirely satisfactory at suppressing the negative effects associated with IED's. Such foams generally do not have sufficient density and/or strength characteristics to adequately suppress compression waves and/or combustion effects produced by IED's. Moreover, existing blast suppression devices frequently require the use of foam enclosures constructed of high strength and/or blast-resistant material(s) which serve as an additional barrier to dampen blast and/or combustion effects resulting from detonation of an IED. Such enclosures can be expensive, unruly and relatively difficult to handle and install around IED's. Moreover, because such enclosures often require physical manipulation, there is always the possibility that an IED could be inadvertently contacted or otherwise disturbed during the installation process.

Existing blast suppression devices utilizing AFFF and/or high expansion foams also suffer from significant environmental limitations. Many AFFF and high expansion foams are environmentally damaging. As a result, AFFF and high expansion foams can not be used in all settings due to the negative impact that said foams can have on the surrounding environment.

Existing blast suppression systems utilizing AFFF and/or high expansion foams also suffer from other practical limitations related to foam preparation and pumping requirements. Such existing systems frequently require relatively large volumes of water, as well as large foam mixing and/or pumping units which can be unruly and difficult to handle. These requirements can be especially problematic when water supply is limited or when space is an issue, such as when an IED is located indoors.

Pump capacity can also present a problem when an IED is situated above ground level (such as on the upper floors of a multi-story building). In such situations, pumping requirements can often be very significant because the foam creates a significant hydrostatic head which must be overcome. In some cases it may not be possible to pump a required amount of foam from a ground-level mixing unit to an above-ground elevation due to pump limitations. Moreover, in many cases, the foam itself must actually be mixed or prepared at the location where the bomb or IED is discovered, which can take up valuable time and manpower resources.

Thus, there is a need for an affordable blast suppression system which can be quickly and easily deployed to reduce and/or eliminate the negative effects resulting from the detonation of IED's and so-called "dirty bombs." The blast suppression system should be easily deployed in order to minimize human exposure to an IED or other suspicious device, and utilize flowable foam which is environmentally benign to avoid contamination of the environment in the general vicinity of said device. The blast suppression system should utilize foam that is substantially pre-mixed in order to eliminate the need for large volumes of water and time consuming or labor intensive on-site preparation of such foam. Furthermore, the blast suppression system should be capable of working indoors or in confined spaces, as well as at above-ground elevations.

SUMMARY OF THE INVENTION

In accordance with the present invention, an improved blast suppression method and apparatus is provided through the use of foam. Said foam is confined in the vicinity of an IED or other suspicious device in order to limit the continued propagation of a blast from said IED. The foam absorbs the compression wave generated by detonation of an IED from all radial directions or, if preferred, selectively absorbs such blast wave so that its continued propagation in particular directions can be suppressed. Said foam also has a cooling effect to substantially reduce or eliminate the combustion effect or fireball produced by an IED A principal advantage of the present invention is that an IED or other suspicious device may be detonated in the location where it is discovered with a marked reduction in the destructive effect of the compression wave, and virtually complete confinement of a fireball (if the explosive is the type that tends to generate combustion) and any subsequent fire or secondary explosion. Since many terrorist and extortion IED's are placed in open areas or in large rooms, an important aspect of the method of the present invention relates to the desired placement of the foam such that a barrier may be provided, relatively easily and effectively, to contain the compressive wave and prevent the continued propagation in undesired directions. Various methods may be used to create the barrier, which may be of various shapes, sizes or configurations, depending upon the nature of the challenge presented and the control desired. Where total blast confinement is desired, a foam containment structure may be utilized having a size and shape which completely surrounds an IED. The actual dimensions of a foam containment structure are preferably such that a sufficient volume of foam can be maintained in place to suppress a compression wave and fireball resulting from detonation of an IED.

The present invention utilizes a plurality of bag-like foam containment structures. Said containment structures can be constructed in any number of shapes and sizes, using different materials as more fully described herein. Ideally, said containment structures are of sufficient size to completely cover an IED or other suspicious device. However, the size and shape of each containment structure will typically depend on the application in question, which will take into account such factors as the size and type of IED, as well as the location where said IED is encountered.

When an IED or suspicious device is encountered, a foam containment structure of the present invention is deployed in close proximity to such IED. In many cases, such foam containment structure is folded for easy handling and placement. A hose or other conduit, which is connected to an inlet port on said foam containment structure, extends to a foam generating unit. Foam produced by such foam generating unit is pumped through said hose, thereby filling or substantially filling said foam containment structure. In the preferred embodiment, after a containment structure fills with foam, the inflated containment structure will completely or substantially cover the IED or other device at issue. If desired, the hose can thereafter be disconnected from the inflated foam containment structure.

After the entire volume within the containment structure is filled with foam, the area around the outside of said containment structure may be cleared of people and the device detonated or otherwise disabled. Since the foam within the containment structure comprises a plurality of small bubbles, an effective blast suppression enclosure is formed of compressible material which absorbs the shock wave and combustion effect caused by an explosive event.

The blast suppression system of the present invention utilizes a high density aqueous which is characterized as producing a high density finished foam solution with substantially uniform bubble structure and enhanced expansion ratios. Such foam also possesses enhanced stable drain times with a favorable finished foam consistency. Smaller uniform bubble structure aids in the foam's ability to suppress detonation shock wave and fragmentation caused by a bomb or other explosive device. Use of such high density aqueous foam, coupled with a foam generating unit that produces a long lasting foam, also results in a foam solution which is more effective at "cooling" of the combustion effect resulting from an explosive event.

In order to improve safety of operating personnel and limit exposure of such personnel to an IED, the present invention can be quickly and easily deployed with minimal exposure to such IED by personnel (as well as bystanders). Moreover, the present invention is compatible with several types and designs of robots and/or remote control devices. Furthermore, in the preferred embodiment, the foam containment structures of the present invention have grab holds and tabbed closures which can fit the grab arms of robots and similar remote control devices. Moreover, the lightweight, non-collapsible and non-kinking hose of the present invention can be easily tracked behind or beside a robot or remote controlled delivery apparatus.

The foam containment structures of the present invention include fill couplings (including check valves) so that a hose can be pre-attached, if desired. Additionally, in the preferred embodiment, each foam containment structure is equipped with an overfill spout. Once a foam containment structure is filled or substantially filled with foam, excess foam can be vented through such overfill spout. Such filling procedures can be monitored from a distance and stopped at any time if desired.

Under some circumstances, placement of a containment structure filled with foam may not be the optimal application. Instead, it may be more desirable to fill a void, such as inside a vehicle or other large container. In such instances, a discharge hose can be manipulated by a technician or robot and placed directly inside the area to be filled. Since overpressure is alleviated from the open end of the hose through a diverter valve, foam will flow gently into the confined area.

The foam of the present invention is non-toxic and biodegradable. Following a blast, the foam evaporates, leaving minimal residue. Any such residue which does remain is non-toxic and easily washed away with water or wiped clean with a cloth.

Due to the density and other characteristics of the foam of the present invention, the fragmentation effects of an explosive device are substantially minimized. Moreover, in many instances, the components of an IED, such as an explosive device container, blasting cap assembly and/or electronic charging wires, will remain relatively intact following an explosive event. As a result, the present invention greatly benefits the collection of evidence and explosive device reconstruction.

Further details of this invention and a greater understanding of the various ways in which it may be practiced may be better understood with reference to the following disclosure in which various forms of the invention are disclosed.

DETAILED DESCRIPTION OF THE PRESENT INVENTION

In the preferred embodiment of the present invention, a foam generating unit is used to generate a high density finished foam solution with a substantially uniform bubble structure and enhanced expansion ratios. Such foam is ideally an alcohol resistant foam possessing enhanced stable drain times. Further, the foaming agent used to make the foam of the present invention is ideally pre-mixed and delivered to a desired location in liquid form. Once on site, such foam can be generated on location using compressed gas. Although any number of gases can be used for this purpose, an inert gas such as nitrogen has been shown to work particularly well because of its ability to retard the combustion effect produced by an explosive event.

The method and apparatus of the present invention can be used to secure an IED or suspicious device and protect surrounding personnel and property until the device can be disarmed, disrupted or detonated. The method and apparatus of the present invention can be used to suppress the blast (compressive wave) and combustion effects resulting from an explosive event.

When an IED or suspicious device is discovered, a foam containment bag of the present invention is deployed proximate to, but not necessarily in contact with, said device. The foam containment bags of the present invention can be constructed, at least in part, of relatively thin, pliable material. In the preferred embodiment, such containment bags are constructed of thin plastic sheeting, such as 3-ml visquine. Said containment bags are ideally foldable, but can be inflated into any number of different shapes to fit a particular application.

Figure 1:
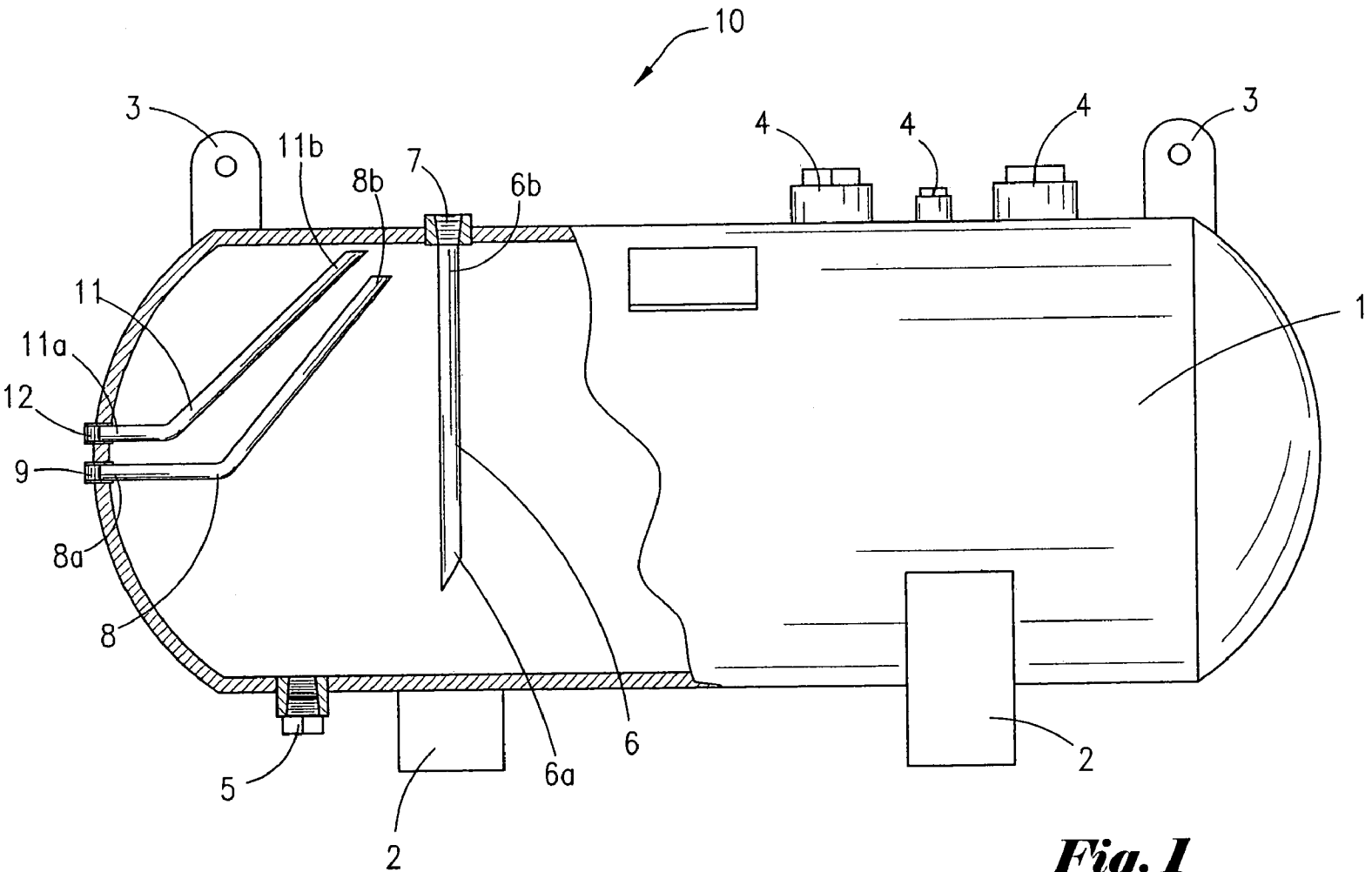
FIG. 1 is a side cut away view of the foam generating unit of the present invention.

Referring to the drawings, FIG. 1 depicts a side cut-away view of the foam generating unit 10 of the present invention. Although said foam generating unit 10 can exhibit any number of different shapes and sizes to accommodate different applications or operating conditions, in the preferred embodiment said foam generating unit 10 comprises generally cylindrical vessel 1. Although not absolutely required, said vessel 1 can be beneficially equipped with base members 2 to provide stability to said unit, and lifting eyelets 3 to provide stability to said unit. Sealable openings 4 can be located on the upper surface of vessel 1, while sealable drain port 5 is situated near the base of vessel 1. Although ports 4 and 5 can be closed using any number of conventional sealing means, in the preferred embodiment said ports are sealed using threaded caps.

Substantially vertical siphon tube 6 extends within vessel 1. Lower end **6*a* of siphon tube 6 is substantially open ended and positioned above, but in general proximity to, base of vessel 1. Upper terminus 6*b* of siphon tube 6 extends to outlet port 7. Although not shown in detail in FIG. 1, an orifice extends through one side of siphon tube 6 near upper terminus 6*b* near where said siphon tube joins with, and connects to, outlet port 7. Gas charging tube 8 extends within vessel 1; lower terminus 8*a* of gas charging tube 8 is connected to port 9 located on the external portion of vessel 1, while open-ended upper terminus 8*b* extends to a point near the top of vessel 1. Similarly, bleed-off line 11 extends from external port 12 near lower terminus 11***a* to open-ended upper terminus 11*b* near the top of vessel 1. In the preferred embodiment, said gas charging tube 8 and bleed-off line 11 both extend upward at an angle.

Figure 2:
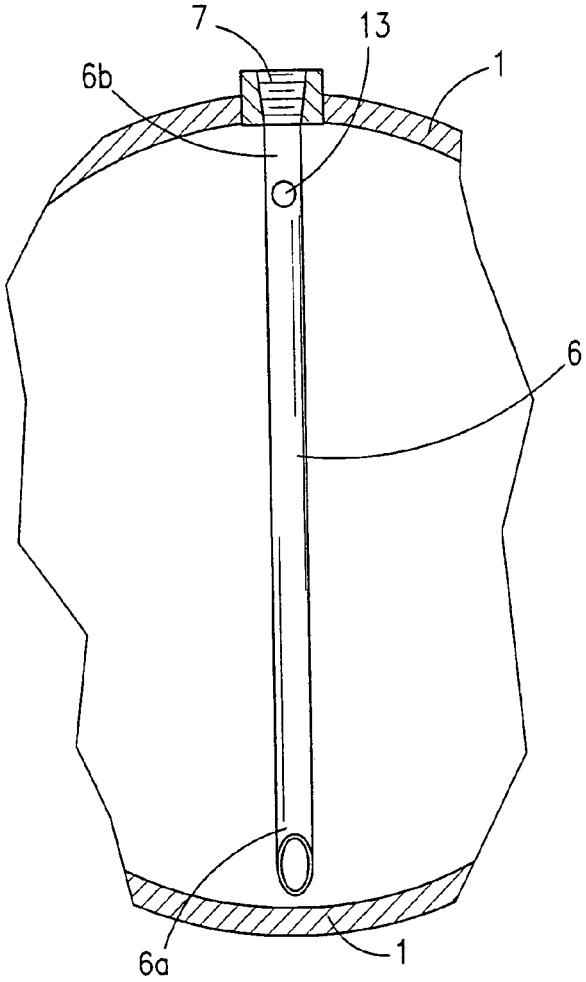
FIG. 2 is a side view of a portion of the foam generating unit of the present invention.

FIG. 2 depicts an isolated detailed view of the siphon tube of the present invention. Siphon tube 6 extends substantially vertically from lower terminus 6*a* to upper terminus 6*b*. Lower terminus 6*a* of siphon tube 6 is situated in general proximity to the lower portion of vessel body 1, while the upper terminus 6*b* of siphon tube 6 connects to vessel outlet port 7. Orifice 13 extends through one side of siphon tube 6 near upper terminus 6*b* of said siphon tube.

Figure 3:
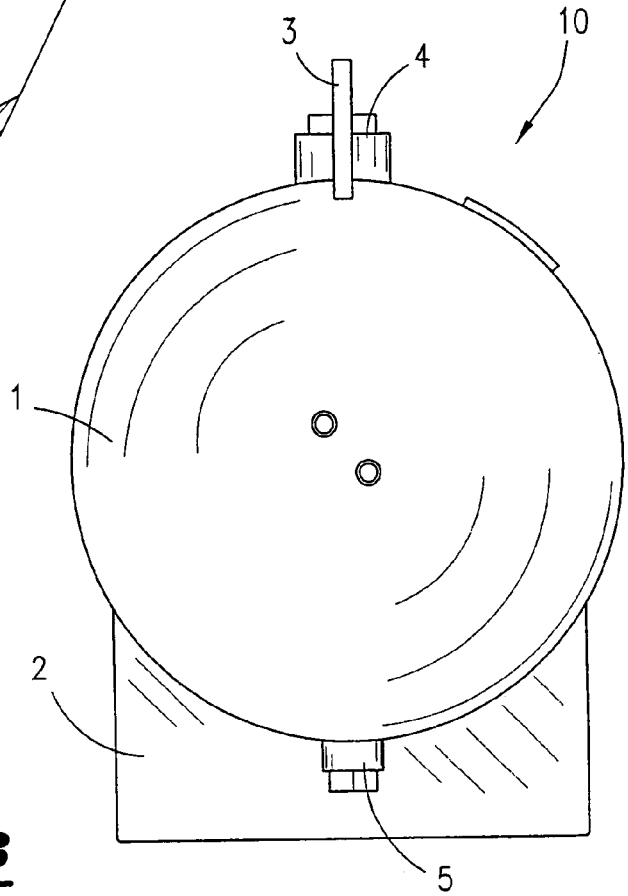
FIG. 3 is an end view of the foam generating unit of the present invention.

FIG. 3 depicts an end view of the foam generating unit 10 of the present invention. Said foam generating unit 10 comprises generally cylindrical vessel 1, base member 2 and lifting eyelet 3. Sealable port 4 is located near the top of vessel 1, while sealable port 5 is located near the bottom of vessel 1. Said sealable openings provide access to the inside of said vessel 1. In particular, sealable opening 5 can serve as a drain port to remove excess liquids from said vessel.

Figure 4:
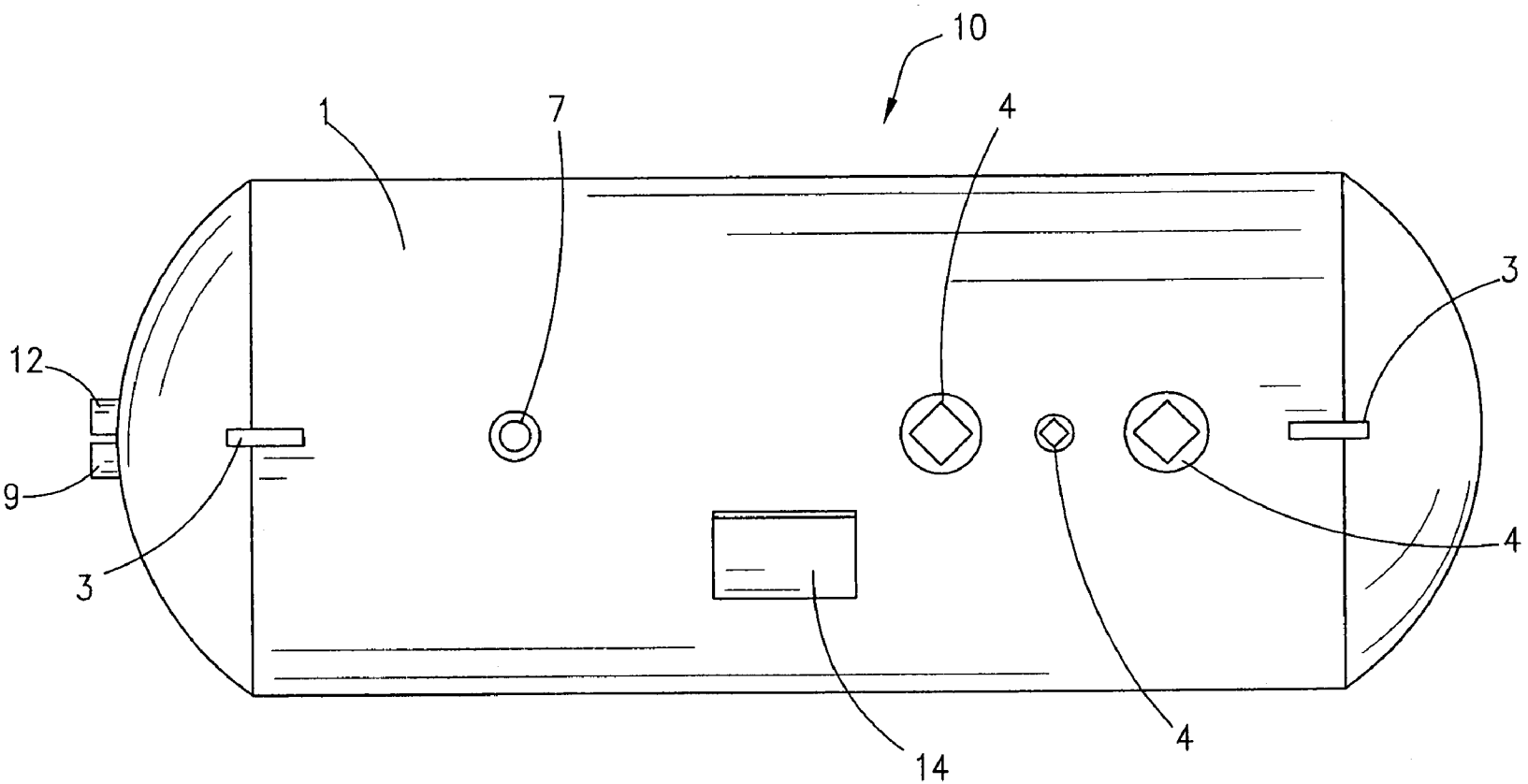
FIG. 4 is a plan view of the foam generating unit of the present invention.

FIG. 4 depicts an overhead view of foam generating unit 10 of the present invention. Said foam generating unit 10 comprises vessel 1. Lifting eyelets 3 and sealable ports 4 are situated on the upper surface of said vessel 1, as is outlet port 7. External port 9 of gas charging tube extends outward from one end of vessel 1. Optional label plate 14 can be affixed to the outer surface of vessel 1.

It is to be understood that the foam generating unit of the present invention can be sized and/or configured many different ways, depending upon a particular application. For example, said foam generating unit can be trailer mounted. Alternatively, said foam generating unit can be equipped with wheels and sized to accommodate most indoor applications.

Figure 5:
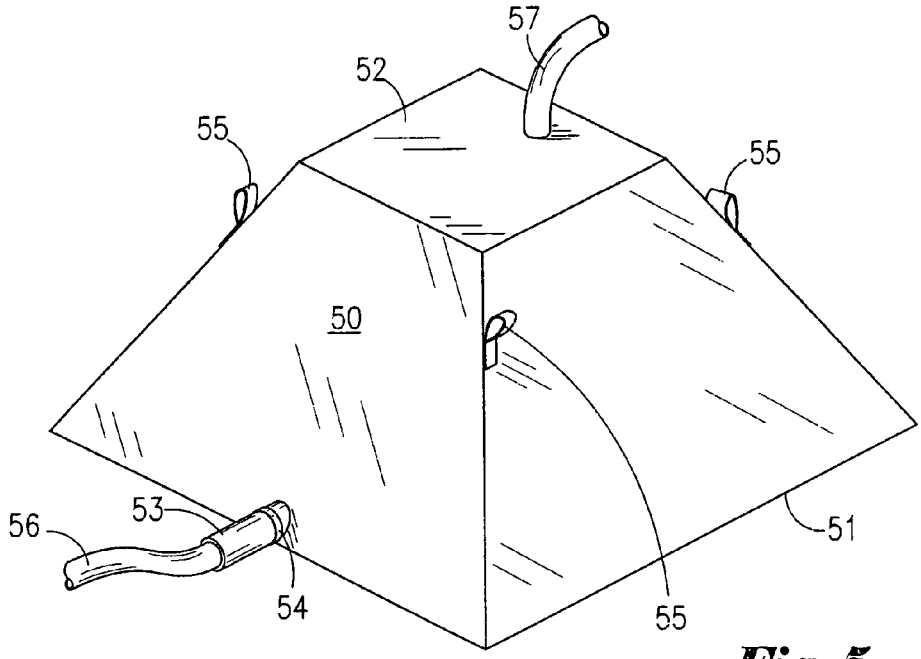
FIG. 5 is a perspective view of one embodiment of a containment enclosure of the present invention.

FIG. 5 depicts a foam containment structure 50 of the present invention. In the preferred embodiment, containment structure 50 is constructed of relatively thin, foldable sheeting, such as 3-ml visquine. Said containment structure 50, when inflated, is in the general shape of a truncated pyramid which is wider at base 51 than at top 52. Containment structure 50 has inlet conduit 53 which extends from the outside of said containment structure 50 through to the inside or inner chamber of said containment structure 50. Check valve 54 allows flow into the inside of said containment structure 50 via inlet conduit 53, but prevents out-flow from said structure in the reverse direction. Flexible hose 56 can be attached to inlet conduit 53 to permit pumping of foam from a distant location into the inner chamber of containment structure 50. Overflow spout 57 permits excess foam to be diverted out of containment structure 50 after said containment structure has been completely or substantially filled with foam.

Still referring to FIG. 5, containment structure 50 has one or more handles 55 to permit positioning and/or other manipulation of said containment structure 50 at or near an IED or other suspicious device. In the preferred embodiment, said handles 55 are loops which can be easily grabbed by a robot or other remote controlled device which can be used to position containment structure 50 as desired.

Figure 6:
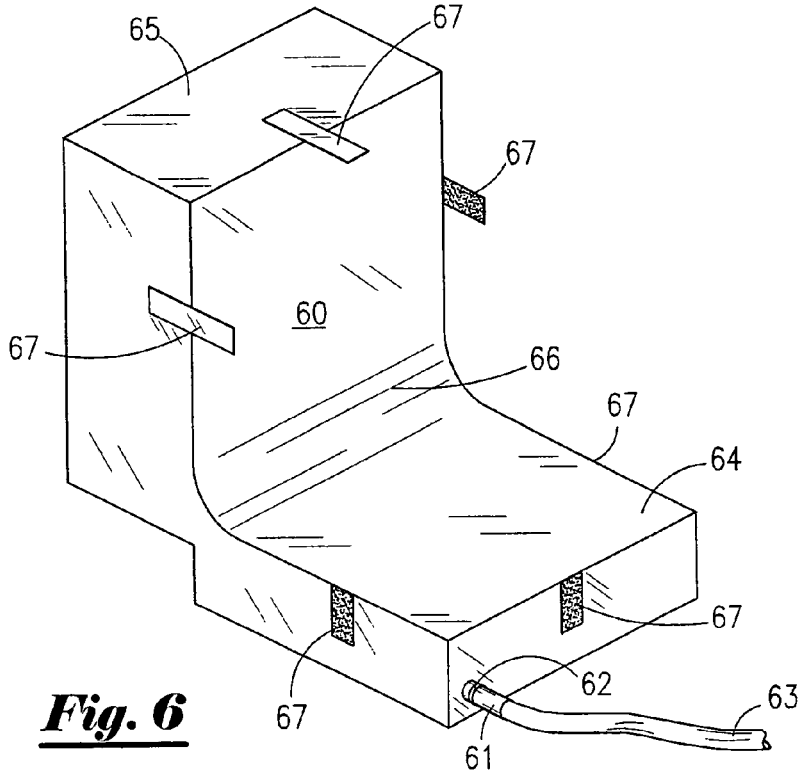
FIG. 6 is a perspective view of one embodiment of a containment enclosure of the present invention for total envelopment of an IED.

FIG. 6 depicts another configuration of a foam containment structure of the present invention. In the preferred embodiment, containment structure 60 depicted in FIG. 6 is constructed of relatively thin foldable sheeting, such as 3-ml visquine. Containment structure 60 has an outward configuration to conform to a desired application. Specifically, containment structure 60 permits encasement of an IED, so as to provide blast suppression in virtually every direction. Containment structure 60 is particularly useful where blast suppression is desired in multiple directions such as, for example but not limitation, when an IED or suspicious device is discovered on an airplane.

Containment structure 60 has inlet conduit 61 which extends from the outside of said containment structure 60 through to the inside of inner chamber of said containment structure 60. Check value 62 permits flow into the inside of containment structure 60 via inlet conduit 61, but prevents out-flow from said containment structure 60 in the opposite direction. Flexible hose 63 can be attached to inlet conduit 61 to permit pumping of foam into the inner chamber of containment structure 60.

Containment structure 60 has base section 64 and upper section 65. Hinge member 66 is located between base section 64 and upper section 65. Upon inflation of said containment structure 60 with foam, hinge member 66 permits said upper section 65 to selectively open and/or close to cover said base section 64. Fasteners 67 are located along the periphery of containment structure 60, and can be used to secure upper section 65 to base section 64 when said sections are inflated with foam and in a closed position. Although any number of different fasteners can be used for this function, in the preferred embodiment fasteners 67 are hook and loop fasteners.

Figure 7:
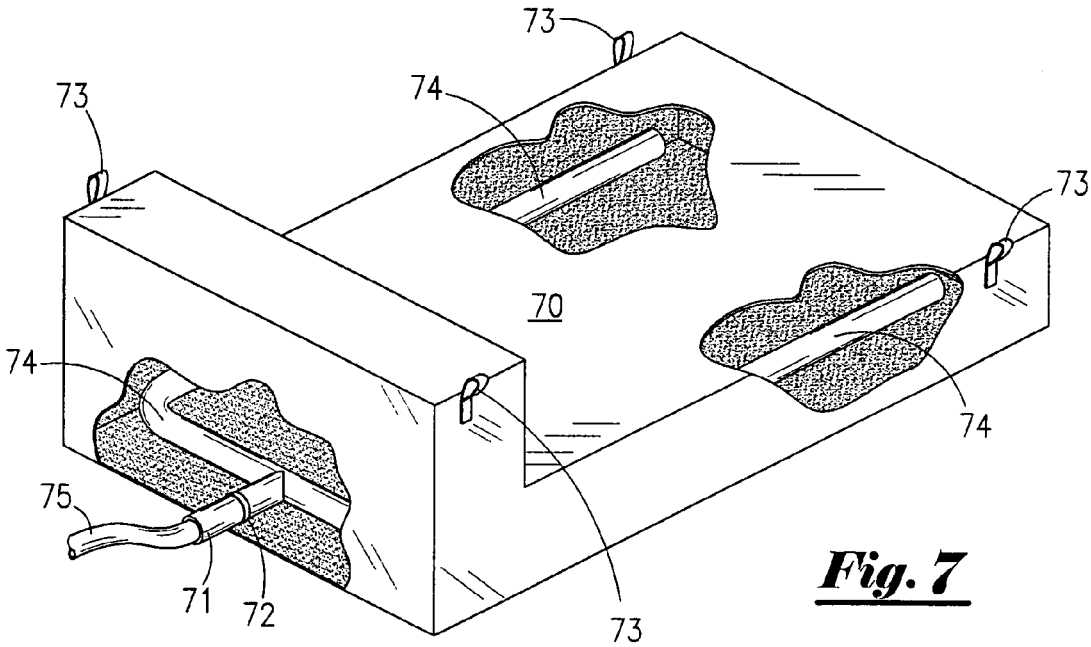
FIG. 7 is a perspective view of one embodiment of a containment device of the present invention for use in connection with a vehicle.

FIG. 7 depicts another foam containment structure 70 of the present invention. In the preferred embodiment, said containment structure 70 is constructed of relatively thin foldable sheeting, such as 3-ml visquine. Containment structure 70 has an outward configuration to conform to a desired application.

Containment structure 70 has inlet conduit 71 which extends from the outside of said containment structure 70 to the inside of inner chamber of said containment structure 70. Check value 72 permits flow into the inside of containment structure 70 via inlet conduit 71, but prevents out-flow from said containment structure 70 in the opposite direction. Flexible hose 75 can be attached to inlet conduit 71 to permit pumping of foam from a distant location into the inner chamber of containment structure 70.

In the preferred embodiment, containment structure 70 also has handles 73 to permit positioning and/or other manipulation of said containment structure 70 relative to an IED or other suspicious device. In the preferred embodiment, said handles 73 are loops which can be easily grabbed by a robot or other remote controlled device which can be used to position containment structure 70 as desired. Containment structure 70 also has internal piping 74 to permit relatively even distribution of foam or other fluid into the inside or inner chamber of containment structure 70.

Containment structure 70 depicted in FIG. 7 can be used in connection with IED's located in vehicles, or other applications in which blast suppression is desired in a downward direction. Specifically, in the case of a suspicious vehicle or vehicle containing an explosive device, containment structure 70 can be deployed beneath the body of said vehicle and inflated. Additionally, if desired, other measures can be taken to suppress a possible blast in other directions such as, for example, filling the passenger compartment of the vehicle with foam.

When an IED or suspicious device is discovered or encountered, the blast suppression apparatus of the present invention can be quickly and easily deployed. Although the basic steps can be performed in a different sequence, the foam generating unit of the present invention is typically first deployed a safe distance from said IED. When the IED is situated in a relatively open or accessible area, it may be desirable to utilize a trailer mounted foam generating unit. Conversely, if an IED is discovered in a more confined setting (such as, for example, on an airplane or in a high-rise building), it may be advantageous to use a smaller or portable foam generating unit.

Once the foam generating unit is deployed, foaming agent is loaded into the vessel of said foam generating unit. By way of illustration, but not limitation, and referring to FIG. 1, foaming agent could be added into vessel 1 of foam generating unit 10 through sealable port 4. In the preferred embodiment, the foaming agent takes the form of a pre-mixed liquid. It should be observed that such liquid foaming agent will inhabit the lower portion of the vessel of the foam generating unit; a portion of such liquid foaming agent will be drawn into vertical siphon tube, such as siphon tube 6 in FIG. 1. Thereafter, foaming gas is injected into the vessel of said foam generating unit through the gas charging tube. Although any number of gases can be used for this foaming function, in the preferred embodiment an inert gas, ideally nitrogen, is used for this purpose. Once said gas is injected into the vessel of the foam generating unit, said gas forms a gas "blanket" over the liquid foaming agent within the upper portion of said vessel. It has been observed that the best results are obtained when the gas pressure (that is, operating pressure) of said foam generating unit is maintained at approximately 40 to 60 psig.

A flexible hose is used to inflate said foam containment structure. One end of a hose is attached to the inlet port of a foam containment structure, while the other end of said hose is attached to the outlet port of the foam generating unit. There is generally no single size or shape of foam containment structure which fits a particular application. Rather, it is to be understood that a foam containment structure can conform to one of the specific sizes or shapes discussed herein, or "custom" designed to satisfy requirements of a particular application. In most applications, said foam containment structure is pre-folded in such a manner that it will unfold as desired relative to an IED or suspicious device upon inflation.

Figure 8:
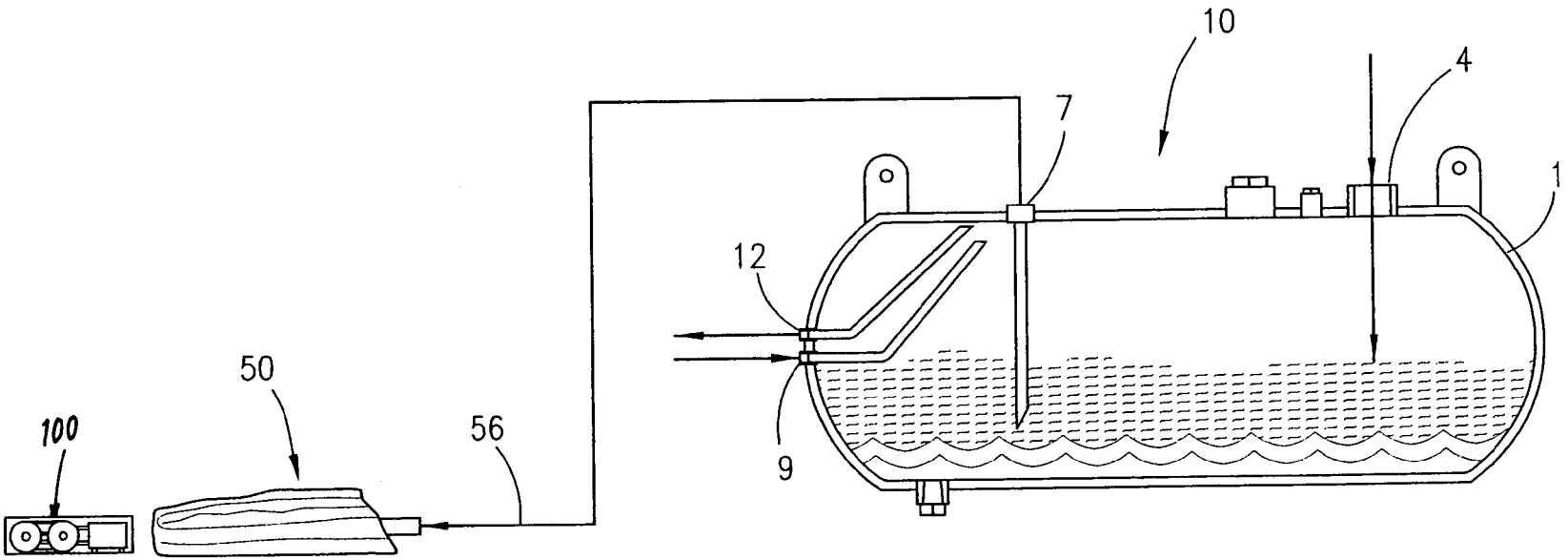
FIG. 8 is a side cut away view of the foam generating unit and folded containment structure deployed in accordance with the present invention.

Referring to FIG. 8, which depicts a side cut away view of a foam generating unit 10 and folded containment structure 50 deployed in accordance with the present invention. Pre-folded foam containment structure 50 is placed in proximity to an IED 100 or other suspicious device. In many cases, this can be accomplished with a robot or other remote controlled device. In other cases, a bomb technician or other person can place said foam containment structure 50. Although it is possible that said foam containment structure 50 could be deployed directly over or around such IED 100, in most applications, the foam containment structure 50 is positioned near the IED 100 without actually touching or physically contacting the IED 100. This is extremely significant because the risk of bumping, jarring or otherwise disturbing the IED 100 is greatly reduced. Moreover, when human beings are required to position the foam containment structure, placement of said foam containment structure can be accomplished quickly with minimal human exposure to the IED 100.

Once the foam containment structure 50 is placed in the desired location, and the bomb technician or robot is a safe distance from the IED 100, foam can be produced with the foam generating unit 10 of the present invention. Foam created in the foam generating unit 10 flows from said foam generating unit 10 through a flexible hose and into the pre-positioned folded foam containment structure 50, thereby allowing said foam containment structure 50 to inflate to its desired configuration. In most cases, the foam containment structure will inflate in such a manner that it will unfold to completely cover or encase the IED 100 which is the focus of concern. If desired, the hose can then be disconnected from said foam containment structure 50 and moved away from the IED 100, or otherwise stored in a safe location.

It is important to note that all foam is generated at the foam generating unit 10 and, more specifically, at the orifice in the siphon tube near the outlet port of the foam generating unit 10. Thus, inflation of the foam containment structure 50 is controlled from the foam generating unit 10 which, as set forth above, is ideally situated a safe distance away from an IED 100. As a result, there is no need for a bomb technician to remain in close proximity to the IED 100 during the foam inflation process. In other words, inflation of the foam containment structure 50 can be accomplished and controlled from a safe distance away from the IED 100.

It should be noted that the foam containment device of the present invention acts as an impermeable barrier between the foam of the present invention and an IED. As such, unlike other methods of using foam for blast suppression, the foam of the present invention does not actually come in contact with said IED unless or until the IED is actually detonated and the integrity of the foam containment device is compromised. Isolating the foam from the IED greatly reduces the likelihood that such foam will inadvertently cause detonation of the IED, particularly in the case of explosive devices which have electronic components. Notwithstanding the foregoing, once an IED is detonated, it is actually more desirable to have such foam come directly in contact with the IED in order to absorb the energy produced by said IED. Thus, while high strength material may be used for a portion of each foam containment structure, in the preferred embodiment of the present invention, the part of a foam containment structure which is immediately adjacent to an IED should ideally be constructed of lesser-strength material which can give way upon detonation, such as, for example, 3-mil visquine.

Although it is envisioned that the foam generating unit of the present invention can be operated at a wide variety of different operating pressures, best results have been obtained when said foam generating unit operates at operating pressures in the range between about 40 to 60 psig. The aforementioned range of pressures facilitates generation of foam having desired characteristics such as greater expansion and uniform bubble structure, while allowing controlled flow into a foam containment structure, resulting in "gentle" inflation of said containment structure.

Likewise, it is also envisioned that the foam of the present invention could exhibit a wide range of different physical characteristics. However, in the preferred embodiment, said foam is Class "B" Alcohol Resistant ("AR")-AFFF foam which is well known in the fire fighting industry. In most standard fire-fighting applications, such Class "B" AR-AFFF foam is typically mixed at approximately 3% concentration (that is, 3 gallons of foaming agent for each 100 gallons of water). In the preferred embodiment of the present invention, said foam is mixed at about a 25% concentration; that is, 25 gallons of Class "B" AR-AFFF foaming agent are mixed with each 100 gallons of water.

Once a foam containment structure of the present invention is deployed near an IED, and filled with foam in accordance with this invention, said foam and foam containment structure collectively serve as a protective barrier to suppress harmful blast effects associated with said IED, and to reduce damage to the surrounding environment. Said foam serves to absorb, and thereby suppress, shock waves, combustion and/or fragmentation caused IED's. Said foam and containment structure also contain any radioactive contaminants which would otherwise be widely dispersed in the case of so-called "dirty bombs" or radiological devices.

In the preferred embodiment, the foam produced by the foam generating unit is about a 50/50 ratio between inert gas (ideally nitrogen) and Class "B" AR-AFFF foaming agent mixed at about a 25% concentration. It has been observed that this foam ratio is best achieved when the ratio between the diameter of the siphon tube of the foam generating unit, and the diameter of the orifice in said siphon tube, is 3:1. For example, referring to FIG. 2, when siphon tube 6 has an internal diameter of ¾", orifice 13 should be ¼" in diameter.

Whereas the invention is herein described with respect to a preferred embodiment, it should be realized that various changes may be made without departing from essential contributions to the art made by the teachings hereof.

What is claimed is:

1. A method for suppressing a blast from an explosive device comprising:

a) positioning a bag in proximity to said explosive device;

b) generating flowable foam using a portable foam generating unit comprising a pressurized vessel having a top, a bottom, an outer surface, an internal chamber, at least one input port, at least one output port and a siphon tube vertically disposed within said internal chamber, wherein said siphon tube extends substantially from said top to said bottom;

c) substantially filling said bag with said flowable foam; and d) substantially covering said explosive device with said substantially filled bag while keeping the flowable foam isolated from said explosive device.

2. A method for suppressing a blast from an explosive device comprising:

a) positioning a folded bag in proximity to said explosive device;

b) generating flowable foam using a portable foam generating unit comprising a pressurized vessel having a top, a bottom, an outer surface, an internal chamber, at least one input port, at least one output port and a siphon tube vertically disposed within said internal chamber, wherein said siphon tube extends substantially from said top to said bottom;

c) substantially filling said bag with said flowable foam and causing said bag to unfold; and d) substantially covering said explosive device with said substantially filled bag while keeping the flowable foam isolated from said explosive device.

* * * * *